US009945608B2

(12) United States Patent
Ploeger et al.

(10) Patent No.: US 9,945,608 B2
(45) Date of Patent: Apr. 17, 2018

(54) NATURAL GAS PROCESSING PLANT

(75) Inventors: Jason Michael Ploeger, Perkasie, PA (US); Timothy Christopher Golden, Nantes (FR); Jeffrey Raymond Hufton, Fogelsville, PA (US); John Eugene Palamara, Macungie, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 1285 days.

(21) Appl. No.: 13/555,680

(22) Filed: Jul. 23, 2012

(65) Prior Publication Data

US 2013/0186133 A1 Jul. 25, 2013

Related U.S. Application Data

(60) Provisional application No. 61/514,081, filed on Aug. 2, 2011.

(51) Int. Cl.

| | |
|---|---|
| ***F25J 3/08*** | (2006.01) |
| ***C10L 3/10*** | (2006.01) |
| ***F25J 3/02*** | (2006.01) |

(52) U.S. Cl.

CPC . *F25J 3/08* (2013.01); *C10L 3/10* (2013.01); *C10L 3/101* (2013.01); *F25J 3/0209* (2013.01); *F25J 3/0233* (2013.01); *F25J 3/0238* (2013.01); *F25J 2200/02* (2013.01); *F25J 2200/70* (2013.01); *F25J 2205/04* (2013.01); *F25J 2205/40* (2013.01); *F25J 2205/60* (2013.01); *F25J 2205/64* (2013.01); *F25J 2210/06* (2013.01); *F25J 2240/02* (2013.01); *F25J 2290/80* (2013.01)

(58) Field of Classification Search

CPC ..... F25J 2205/64; F25J 2290/80; F25J 3/0233
USPC ..... 62/636
See application file for complete search history.

(56) References Cited

U.S. PATENT DOCUMENTS

| | | | | |
|---|---|---|---|---|
| 3,735,600 | A | 5/1973 | Dowdell et al. | |
| 4,157,904 | A | 6/1979 | Campbell et al. | |
| 5,171,333 | A | 12/1992 | Maurer | |
| 5,689,032 | A * | 11/1997 | Krause | C07C 7/005 208/100 |
| 5,840,999 | A | 11/1998 | Kratz et al. | |
| 6,444,012 | B1 | 9/2002 | Dolan et al. | |
| 6,497,750 | B2 | 12/2002 | Butwell et al. | |

(Continued)

FOREIGN PATENT DOCUMENTS

| | | |
|---|---|---|
| EP | 1 483 036 A1 | 12/2004 |
| WO | 03/078029 A1 | 9/2003 |

OTHER PUBLICATIONS

Collins, C., et al.; "Trends in NGL Recovery from Natural and Associated Gases"; Gastech Meeting on LNG and LPG; Nov. 1, 1984; pp. 287-303.

(Continued)

*Primary Examiner* — Tareq Alosh
(74) *Attorney, Agent, or Firm* — Amy Carr-Trexler

(57) ABSTRACT

The invention provides systems and methods for separating ethane and heavier hydrocarbons from a natural gas stream. In aspects of the invention, an adsorption unit is integrated with a cryogenic gas processing plant in order to overcome methane recovery limitations by sending the tail gas from the adsorption unit to the cryogenic gas processing plant to recover methane that would otherwise be lost.

8 Claims, 3 Drawing Sheets

Returning the PSA purge gas to the lower demethanizer column feed

(56) References Cited

U.S. PATENT DOCUMENTS

| | | | | |
|---|---|---|---|---|
| 6,610,124 | B1 | 8/2003 | Dolan et al. | |
| 7,396,388 | B2 | 7/2008 | Mitariten | |
| 7,442,233 | B2 | 10/2008 | Mitariten | |
| 2004/0050095 | A1 * | 3/2004 | Brigham ..... | F25J 3/04254 62/643 |
| 2006/0191410 | A1 | 8/2006 | Dolan et al. | |
| 2008/0282884 | A1 | 11/2008 | Kelley et al. | |

OTHER PUBLICATIONS

Avila, A.M., Extraction of Ethane From Natural Gas at High Pressure by Adsorption on Na-ETS-10, Chemical Engineering Science 66, 2011, pp. 2991-2996.

Kumar, R., A Versatile Process Simulator for Adsorptive Separations, Chemical Engineering Science, 1994, vol. 49, No. 18, pp. 3115-3125.

Ping, Liang, et al., Gathering & Transmission Techniques for Natural Gas, Petroleum Industry Press, May 2008, p. 107.

* cited by examiner

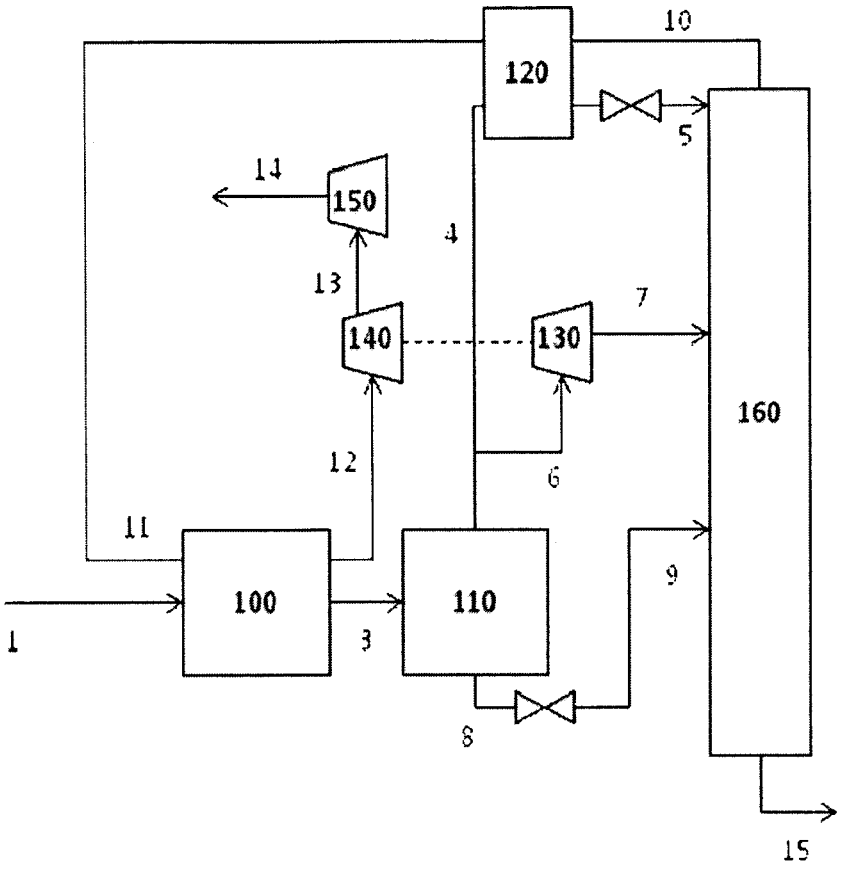
Figure 1 – Prior Art

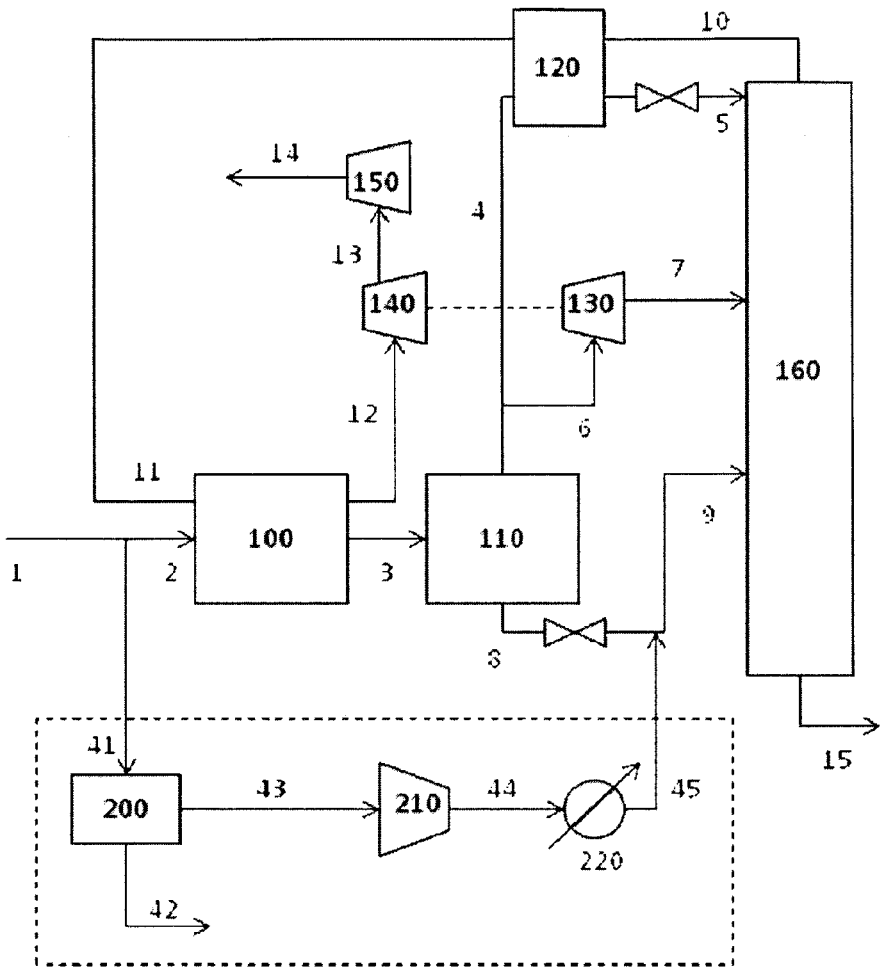
Figure 2: Returning the PSA purge gas to the lower demethanizer column feed

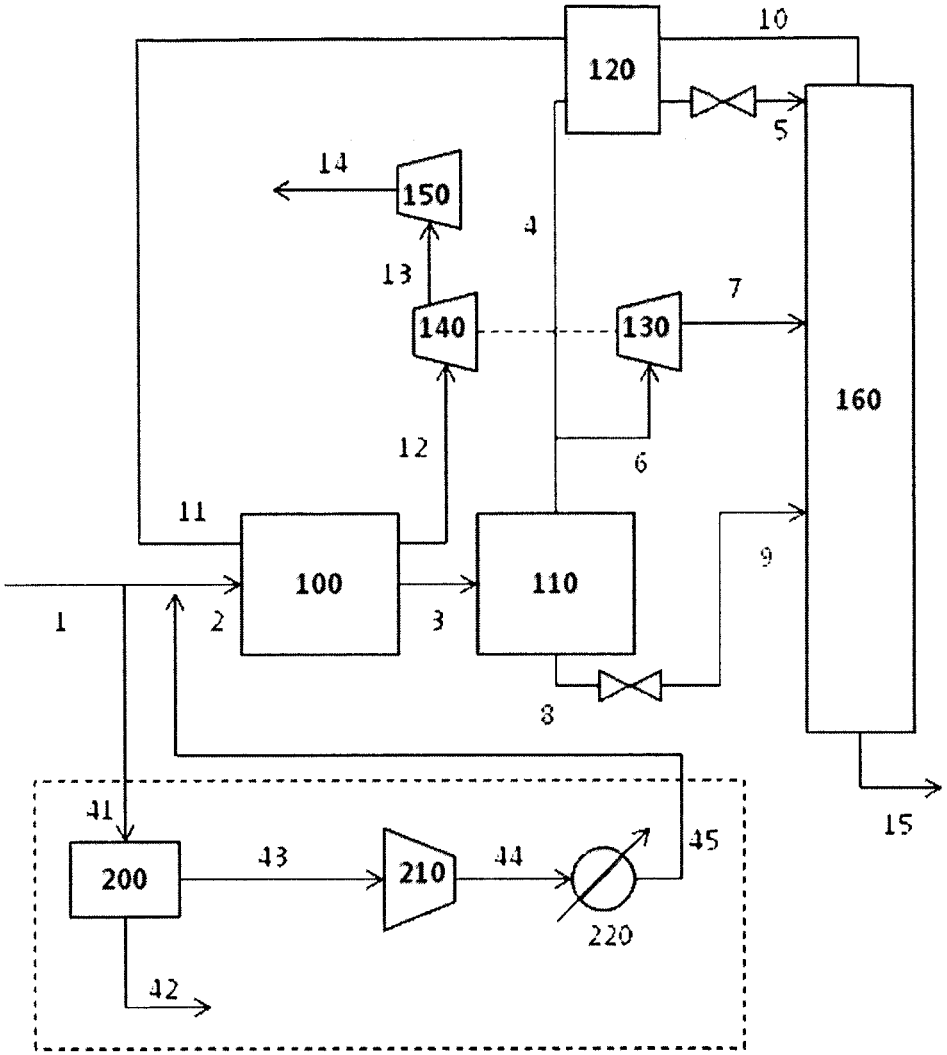
Figure 3: Returning the PSA purge gas to the main plant feed

NATURAL GAS PROCESSING PLANT

CROSS-REFERENCE TO RELATED APPLICATIONS

This application claims priority to U.S. Provisional Application Ser. No. 61/514,081 filed on Aug. 2, 2011. This provisional application is wholly incorporated herein by reference.

BACKGROUND OF THE INVENTION

This invention relates to processing gas streams comprising methane and other hydrocarbons in order to remove the other hydrocarbons.

Natural gas often contains high concentrations of natural gas liquids (NGL) including ethane, propane, butane, and higher hydrocarbons, among other compounds. The NGL are often removed in a gas processing plant prior to supplying methane to a pipeline (e.g., in order to meet specifications defining the composition of material supplied to the pipeline). The heavy hydrocarbons are typically removed as a mixed liquid product that can be fractionated into valuable purity products, such as ethane which is a chemical feedstock. Any propane and butane present in the NGL can be blended to form liquefied petroleum gas (LPG), a valuable residential fuel. NGL prices tend to be linked to the price of petroleum, thereby increasing the value of the removable NGL when natural gas prices are low but petroleum prices are high.

Conventional options for the removal of NGL include refrigeration, wherein the natural gas is chilled until heavy compounds such as hexanes and heavier ($C_6$+ hydrocarbons) condense out of a feed stream. Another conventional option is absorption, wherein NGL are removed by being contacted with a light oil (e.g. kerosene range), that has high recovery of butanes and heavier ($C_4$+) and moderate recovery of propane. Refrigerating the lean oil to −30 to −40° F. improves propane recovery and can achieve as high as 50% ethane recovery.

In order to achieve 90+% recovery of ethane and 98+% recovery of $C_3$+, cryogenic or turboexpander plants are typically used. These plants use the expansion of the natural gas stream to reduce the temperature to −100 to −150° F. wherein the natural gas is mostly liquid and can be separated using a distillation column. These columns are referred to as demethanizers when the bottoms are $C_2$+ and deethanizers when the bottoms are $C_3$+. Turboexpanders can be used to generate a portion of the compression power for returning the sales gas stream to pipeline pressure. This increases the overall efficiency of the process.

In the late-1970s the Ortloff Corporation developed the gas-subcooled process (GSP) that improved NGL recovery by adding a subcooled reflux stream to the top of the demethanizer. GSP and related processes are the dominant technology used to recover NGL because they are the most cost effective way to achieve high $C_2$ recoveries and maximize the economic output of a natural gas well.

Two key disadvantages of GSP are the compression costs to bring the recovered gas back to pipeline pressure and the lack of flexibility in capacity. GSP plants add capacity via large trains and are less tolerant of turndown than adsorption processes because either the turboexpander will not be able to achieve the low temperatures needed to operate the demethanizer, or the flow rates in the demethanizer will be insufficient to maintain the proper flow patterns.

The optimal efficiency of turboexpander plants comes at an operating point close to full design capacity. As feed rate rises, there can be multiple equipment-related bottlenecks that prevent further plant loading. These include limitations associated with excessive vapor flow rate in the demethanizer causing entrainment or flooding, lack of refrigeration, inability to compress the residue gas to pipeline pressure, or lower NGL recovery leading to a residue gas with a heating value that exceeds pipeline specifications.

Certain conventional adsorption processes are well known for removing NGL from natural gas streams and have the advantage of maintaining the sales gas at an elevated pressure. However, these processes suffer from lower methane recovery rates than any other technology described above. Whereas GSP recovers well over 99% of the methane, even the best adsorption process will have recoveries in the 75-85% range because some of the natural gas feed will be used to regenerate the bed.

Conventional NGL processing systems are disclosed by M. Mitariten (U.S. Pat. No. 7,396,388 and U.S. Pat. No. 7,442,233) which provides an integrated system of Pressure Swing Adsorption (PSA), amine scrubbing, and adsorptive water adsorption that removes acid gases, water, and heavy hydrocarbons ($C_4$+) from a natural gas stream.

Dolan and Butwell (U.S. Pat. No. 6,444,012) teach the use of a PSA to reject $C_3$+ components from a raw natural gas feed combined with a second $N_2$-rejection PSA to produce an enriched $CH_4$ stream. The product stream from the second PSA is used to regenerate the first PSA and recover the heating value of the higher alkanes in the methane product.

Butwell et al. (U.S. Pat. No. 6,497,750) also teach two PSAs in series for $N_2$ rejection from methane. The first PSA removes $N_2$ from raw natural gas. The waste stream from this PSA contains $N_2$, $CH_4$, and heavies, and is compressed and passed to the second PSA containing a $CH_4$-selective adsorbent to produce an $N_2$ product. The waste stream from this second PSA is $CH_4$-rich and is recycled to the first PSA after removal of heavies by refrigeration.

B. T. Kelley et al. (US 2008/0282884) describe a monolith adsorbent in a PSA system that discloses $C_1/CO_2$ and $C_1/N_2$ separation.

Avila et al. ("Extraction of ethane from natural gas at high pressure by adsorption on Na-ETS-10," Chem. Eng. Sci. 66:2991-2996, 2011) describes a very high selectivity of ethane over methane in a modified zeolite.

Maurer (U.S. Pat. No. 5,171,333) teaches methane purification by PSA using ZnX and CaY zeolite adsorbent.

W. C. Kratz et al. (U.S. Pat. No. 5,840,099) describes a combined pressure swing/vacuum swing adsorption unit to remove water, $CO_2$, $C_3$+, and some ethane from a natural gas stream so that the methane-rich stream could be used as a transportation fuel.

The disclosure of the previously identified patents, patent applications and publications are hereby incorporated by reference.

There is a need in this art for an improved system and method for removing NGL from natural gas. More specifically, there is a need for a mobile separation system that can be used to effectively debottleneck an existing gas plant.

BRIEF SUMMARY OF THE INVENTION

This invention solves problems associated with conventional adsorption technology by providing systems and methods that improve heavy hydrocarbon removal by achieving high recovery (>80%) of $C_2$ and nearly 100% recovery of $C_3$+. The instant invention also provides a strategy for integration into a natural gas processing plant that can improve the capacity of the plant.

Broadly, the instant invention provides systems and methods for separating ethane and higher hydrocarbons from a natural gas stream. The instant invention employs a relatively low selectivity adsorbent that has the advantage of being easier to regenerate as well as being an order of magnitude less expensive than other common adsorbents.

One aspect of the invention relates to using an adsorption unit integrated with a cryogenic gas processing plant in order to overcome methane recovery limitations by sending the tail gas from the adsorption unit to the cryogenic gas processing plant to recover methane that would otherwise be lost.

One aspect of the invention relates to using an adsorption unit to process a portion of the cryogenic gas processing plant feed to allow greater flexibility in the amount of natural gas that the original cryogenic gas processing plant can process.

Another aspect of the invention relates to adsorption processes that retain high efficiencies at turndown compared to cryodistillation processes. This is particularly advantageous when applied to a natural gas source with a highly variable flow such as shale gas wells.

A further aspect of the invention relates to an adsorption method wherein methane remains at elevated pressure and needs no further compression to enter the pipeline.

In a further aspect of the invention, the adsorption unit can be made portable so that it increases the capacity of a turboexpander plant allowing higher throughput while an additional cryodistillation train is constructed. Once the second train is commissioned, the adsorption unit can be moved to another plant requiring efficiency improvement.

One aspect of the invention relates to a system for removing natural gas liquids from raw natural gas comprising: (i) an adsorption unit configured to receive a raw natural gas stream and remove natural gas liquids from the raw natural gas stream to produce a first stream comprising natural gas liquids and a second stream comprising pipeline quality gas, (ii) a compressor configured to receive the first stream and produce a compressed first stream, (iii) a heat exchanger configured to receive the compressed first stream; and (iv) a demethanizer configured to remove at least a portion of the methane from the compressed first stream, wherein the bottom product of the demethanizer comprises natural gas liquids.

Another aspect of the invention relates to a system for treating raw natural gas comprising: (i) an adsorption unit configured to receive a raw natural gas stream and produce a first stream having a reduced amount of natural gas liquids and a second stream enriched in natural gas liquids; (ii) a compressor configured to receive the second stream and produce a compressed second stream; (iii) a heat exchanger configured to receive the compressed second stream exiting the compressor; and (iv) a gas processing plant configured to receive the compressed second stream exiting the heat exchanger.

A further aspect of the invention relates to a method for producing natural gas liquids and natural gas comprising: (i) providing raw natural gas to a system disclosed herein; and (ii) recovering natural gas liquids and natural gas, wherein the natural gas is pipeline quality gas.

A further aspect of the invention relates to a method for producing pipeline quality gas comprising: (i) providing raw natural gas to a system disclosed herein; and (ii) recovering pipeline quality gas.

BRIEF DESCRIPTION OF SEVERAL VIEWS OF THE DRAWINGS

FIG. 1 is a schematic drawing of a prior art natural gas processing plant.

FIG. 2 is a schematic drawing of one aspect of the invention wherein a purge stream from a PSA is supplied to a lower demethanizer column feed.

FIG. 3 is a schematic drawing of a second aspect of the invention wherein a purge stream from a PSA is supplied to a processing plant feed stream

DETAILED DESCRIPTION OF THE INVENTION

The following Definitions are used throughout this disclosure:

"Demethanizer" means a distillation column with a bottom reboiler, zero, one, or more than one side reboiler, and no condenser that separates methane from heavier hydrocarbons.

"NGL" means natural gas liquids, defined as ethane and longer-chain hydrocarbons such as propane, butane and higher hydrocarbons ($C_5$+).

"Raw natural gas" means a feed to a gas processing plant that comprises NGL or at least one component of NGL. Raw natural gas is considered to already have $CO_2$, $H_2S$, $N_2$, and $H_2O$ removed if needed. Typical properties of raw natural gas as it enters the gas processing plant are (compositions in mole percent): (a) pressure from about 700 to about 1200 psia, or from about 800 to about 1000 psia; (b) temperature typically close to ambient temperature; (c) methane concentration from about 65% to about 95%, or from about 80% to about 90%; (d) ethane concentration from about 3% to about 20%; (e) propane concentration from about 1% to about 10%; (f) butanes and higher hydrocarbon concentration up to about 10%; (f) carbon dioxide concentration up to about 2% (typically carbon dioxide is removed, such as by using an amine absorber column, in order to prevent freezing in the demethanizer column); (g) hydrogen sulfide concentration less than about 1 grain per 100 standard cubic feet for natural gas (roughly 15 ppmv) or less than 5 ppmv for pipline natural gas; (h) nitrogen concentration up to about 3% as determined by pipeline specifications (if the amount of nitrogen is greater than the pipeline specifications then the nitrogen can be removed, such as in a cryogenic or membrane system); and (i) water vapor concentration typically below 1 ppmv (which can be achieved, for example, by treating in a molecular sieve adsorption unit).

"Pipeline quality gas" means raw natural gas (as described above) that has had enough ethane, propane, butane, and heavier hydrocarbons removed to reach a composition suitable for sale into a pipeline as natural gas. In the case of NGL-rich feed gas this means reducing the higher heating value (HHV) of the gas to less than about 1100 BTU/standard cubic foot (SCF, typically using a reference state of 60° F. and 1 atmosphere pressure) to form this pipeline quality gas.

"Residue gas" means gas from the demethanizer overhead, which may be recompressed and sold to natural gas pipelines.

When certain process streams exiting an apparatus herein are described as "enriched" or "depleted" in a certain component, what is meant is that the concentration of that component in the referenced stream is either greater than (enriched) or less than (depleted) the concentration of the same component in the feed stream to that apparatus.

Aspects of the invention are described with reference to the following lettered paragraphs:

A. A system for removing natural gas liquids from raw natural gas comprising: (i) an adsorption unit configured to receive a raw natural gas stream and remove natural gas liquids from the raw natural gas stream to produce a first stream comprising methane and enriched in natural gas liquids and a second stream comprising methane and depleted in natural gas liquids; (ii) a compressor or pump configured to receive and increase the pressure of the first stream; and (iii) a demethanizer configured to remove at least a portion of the methane from the compressed first stream, wherein the bottom product of the demethanizer comprises natural gas liquids; wherein the second stream has a higher heating value less than 1100 BTU/SCF.

B. The system of paragraph A, further comprising a heat exchanger configured to receive and cool the first stream.

C. The system of any of paragraphs A through B, wherein the raw natural gas stream comprises at least 60% methane by volume.

D. The system of any of paragraphs A through C, wherein the raw natural gas stream comprises less than 2% carbon dioxide by volume.

E. The system of any of paragraphs A through D, wherein the raw natural gas stream comprises less than 100 ppm water vapor by volume.

F. The system of any of paragraphs A through E, wherein the pressure of the raw natural gas stream is greater than 700 psia.

G. The system of any of paragraphs A through F, wherein the adsorption unit is a pressure swing adsorption unit.

H. The system of paragraph G, wherein the lowest pressure in the pressure swing adsorption unit during any single cycle is 1 atm.

I. The system of any of paragraphs A through F, wherein the adsorption unit is a vacuum swing adsorption unit.

J. The system of paragraph I, wherein the lowest pressure in the vacuum swing adsorption unit during any single cycle is 0.05 atm.

K. The system of any of paragraphs A through J, wherein the beds of the adsorption unit have a length to diameter ratio less than 1.5.

L. The system of any of paragraphs A through K, wherein a portion of the compressed first stream is compressed to the pressure of the raw natural gas stream, recycled, and fed to the adsorption unit.

M. The system of any of paragraphs A through L, wherein the adsorption unit is portable.

N. A system for treating raw natural gas comprising: (i) an adsorption unit configured to receive a raw natural gas stream and produce a first stream comprising methane and enriched in natural gas liquids and a second stream comprising methane and depleted in natural gas liquids; (ii) a compressor or pump configured to receive and increase the pressure of the first stream; and (iii) a gas processing plant configured to receive the gas processing plant feed stream.

O. The system of paragraph N, further comprising a heat exchanger configured to receive and cool the first stream.

P. The system of any of paragraphs N through O, wherein the raw natural gas stream comprises at least 60% methane by volume.

Q. The system of any of paragraphs N through P, wherein the raw natural gas stream comprises less than 2% carbon dioxide by volume.

R. The system of any of paragraphs N through Q, wherein the raw natural gas stream comprises less than 100 ppm water vapor by volume.

S. The system of any of paragraphs N through R, wherein the pressure of the raw natural gas stream is greater than 700 psia.

T. The system of any of paragraphs N through S, wherein the adsorption unit is a pressure swing adsorption unit.

U. The system of paragraph T, wherein the lowest pressure in the pressure swing adsorption unit during any single cycle is 1 atm.

V. The system of any of paragraphs N through S, wherein the adsorption unit is a vacuum swing adsorption unit.

W. The system of paragraph V, wherein the lowest pressure in the vacuum swing adsorption unit during any single cycle is 0.05 atm.

X. The system of any of paragraphs N through W, wherein the beds of the adsorption unit have a length to diameter ratio less than 1.5.

Y. The system of any of paragraphs N through X, wherein a portion of the first stream is compressed to the pressure of the raw natural gas stream, recycled, and fed to the adsorption unit.

Z. The system of any of paragraphs N through Y, wherein the gas processing plant comprises: (a) a main raw natural gas feed stream; (b) a first heat exchanger configured to receive and cool the main raw natural gas feed stream to produce a cooled feed stream; (c) a separation unit configured to receive the cooled feed stream and separate it into a vapor feed stream and a liquid feed stream; (d) an expander configured to receive and expand a portion of the vapor feed stream to form a main demethanizer feed stream; (e) a second heat exchanger configured to receive and condense a portion of the vapor feed stream, a portion of the cooled feed stream, a portion of a demethanizer overhead stream, or any combination thereof to form a methanizer reflux stream; and (f) a demethanizer configured to receive the main demethanizer feed stream, the liquid feed stream, and the methanizer reflux stream and produce the demethanizer overhead stream comprising methane and a demethanizer bottoms stream comprising natural gas liquids.

AA. The system of paragraph Z, wherein the gas processing plant feed stream is combined with the main raw natural gas feed stream and fed to the first heat exchanger.

BB. The system of paragraph Z, wherein the gas processing plant feed stream is combined with the liquid feed stream and fed to the demethanizer.

CC. The system of any of paragraphs N through BB, wherein the adsorption unit is portable.

DD. A system for removing natural gas liquids from raw natural gas comprising: (i) a membrane separation unit configured to receive a raw natural gas stream and remove natural gas liquids from the raw natural gas stream to produce a first stream comprising methane and enriched in natural gas liquids and a second stream comprising methane and depleted in natural gas liquids; (ii) a compressor or pump configured to receive and increase the pressure of the first stream; and (iii) a demethanizer configured to remove at least a portion of the methane from the first stream, wherein the bottom product of the demethanizer comprises natural gas liquids; wherein the second stream has a higher heating value less than 1100 BTU/SCF.

EE. A method for producing natural gas liquids and natural gas comprising: (i) providing raw natural gas to a system according to any of the preceding paragraphs; and (ii) recovering natural gas liquids and natural gas, wherein the natural gas has a higher heating value less than 1100 BTU/SCF.

Referring now to the drawings, FIG. 1 is an example of the Ortloff Gas-Subcooled Process (GSP) as described in U.S. Pat. No. 4,157,904; hereby incorporated by reference. The Ortloff GSP is a typical NGL recovery process.

A natural gas feed 1 containing high levels of ethane ($C_2$) and heavier hydrocarbons ($C_3$+) enters a heat exchanger network 100 that chills the feed down to a temperature typically around −30° F. The heat exchanger network can include exchangers with cold residue gas (such as that in column overhead 10) and/or external refrigerant such as propane and/or one or more demethanizer reboilers. Stream 3 then enters a flash separator 110 to separate the vapor and liquid phases. The overhead vapor exiting flash separator 110 is split into two streams. Stream 4 is chilled in a heat exchanger 120 against column overhead 10 and depressurized across a throttle valve to produce reflux stream 5 for demethanizer column 160. Stream 6 is expanded across turboexpander 130 to the demethanizer pressure and forms the main demethanizer feed 7. The bottoms of the flash separator 110, stream 8, is expanded across a throttle valve and feeds the demethanizer at a lower location as stream 9.

The demethanizer 160 is a trayed or packed column with a reboiler (not shown) and potentially one or more side reboilers, but no condenser. Natural gas liquids (NGL) stream 15 leaves the bottom of the demethanizer and can be separated into higher purity products onsite or transported to a central fractionator. The cold residue gas in column overhead 10 is returned to near-ambient temperature in heat exchangers 120 and 100 before entering compressors 140 and 150 to return to pipeline pressure as stream 14. Compressor 140 is driven by turboexpander 130 and compressor 150 is driven by an electric motor, internal combustion engine, or a gas turbine.

Referring now to FIG. 2, one aspect of the invention is illustrated in the dotted-line box. A fraction of feed 1 is diverted as stream 41 to adsorption unit 200. The adsorption unit 200 includes multiple adsorption beds, each packed with one or more layers of solid adsorbent. The adsorption unit 200 can comprise from about 4 to about 16 beds. In certain aspects of the invention, the adsorption unit 200 is a pressure swing adsorption unit (PSA). In the examples that follow, PSAs comprising 5, 6, 10, and 12 beds were evaluated. Each adsorber vessel is subjected to a predefined sequence of process steps that effectively remove impurities from the feed gas during the high pressure feed step and then rejuvenate the adsorbent during the lower pressure regeneration steps. Continuous feed, product, and effluent flows are obtained by staggering the adsorber process steps over multiple adsorber beds. The sequence of process steps for each bed is completed over a period of from about 100 to about 600 seconds. Stream 41 is processed in the adsorption unit 200 via at least the following five steps:

1. Adsorption—The natural gas stream 41 is fed to the adsorption unit 200 at feed pressure and exits in product stream 42. The beds of the adsorption unit 200 may be loaded with any suitable adsorbent having a selectivity preference for ethane over methane, such as for example carbon, silica gel, alumina, or zeolites, among other suitable adsorbents. While any suitable adsorbent can be employed, one preferred adsorbent is alumina (such as Alcan® AA-300 alumina) due to its lower methane heat of adsorption and the consequential reduced thermal impact on PSA performance.
2. Pressure equalization(s)—The adsorption step is followed by from 1 to 6 concurrent pressure equalizations with other adsorber vessels that are being repressurized. These steps are included to improve methane recovery by recovering some of the void methane. More equalizations improve the methane recovery, but are weighed against the increased cost of more adsorber vessels. Alternatively, after the last concurrent pressure equalization step, or between two of the from 1 to 6 concurrent pressure equalizations, the bed is concurrently depressurized to an intermediate pressure and the effluent gas, referred to as purge gas feed, is used to purge another bed in the Blowdown and Purge step.
3. Blowdown and Purge—At the end of the pressure equalization steps, the vessel is depressurized by venting counter currently to nearly atmospheric pressure, and a small amount of the product gas from stream 42 or the purge gas stream (as defined above) is used to countercurrently purge the adsorption beds at this same low pressure. The adsorbed NGL are desorbed from the adsorbent and rejected to stream 43 in this Blowdown and Purge step. Methane is also lost to this effluent stream, which is sent to the gas processing plant.
4. Pressure equalization—From 1 to 6 stages of pressure equalization are conducted to return the adsorption beds to higher pressure.
5. Repressurization—Finally, a fraction of the product methane from stream 42 or a portion of the natural gas feed 41 is used to bring the adsorber vessel pressure to the feed pressure. At this point the adsorber vessel is ready for the next feed step, and the process cycle repeats.

The product gas 42, which is enriched in methane and depleted in NGL, exits the bed at pipeline pressure with a low enough concentration of NGL to meet higher heating value and Wobbe index specifications to be sold into a pipeline as natural gas. The product gas 42 can therefore immediately enter the pipeline with no further treatment, compression, or heat exchange.

Blowdown and purge gas effluent stream 43, which contains a higher concentration of heavy components, is compressed to demethanizer pressure by compressor 210. This purge gas stream has a typical composition, in mole percent, of from about 20% to about 50% methane, from about 25% to about 45% ethane, from about 15% to about 20% propane, and from about 10% to about 15% butane and higher hydrocarbons. It contains a higher level of heavier components than typical feed streams to the demethanizer. Stream 44 exits compressor 210 and is cooled by heat exchanger 220 to the same temperature as the flash separator 110. Resulting stream 45 enters the demethanizer with stream 9. Cooling is accomplished by heat exchange with any suitable process stream and/or propane refrigerant.

Operation of the adsorption unit 200 with multiple parallel beds and staggered process steps allows the overall purge and product flows to be smoothed out to minimize the impact on the gas processing plant. Alternatively, additional vessels can be added between the adsorption unit 200 and the downstream equipment to provide additional dampening of any gas flow or composition variations.

Another aspect of the invention relates to modifying the sequence of adsorber process steps by recycling a portion of the blowdown and purge gas effluent stream 43 back to one of the adsorbers during a waste gas rinse step (not shown). The purpose of this step is to effectively displace additional adsorbed and interstitial methane to the product stream 42. This step is conducted either between steps 1 (Adsorption) and 2 (Pressure Equalization) or during step 2 after one of the one to six concurrent pressure equalization steps. The waste gas rinse stream is fed to the feed end of the adsorption unit 200 and comprises a portion of stream 43 compressed to feed pressure.

In another aspect of the invention, adsorption unit 200 is a vacuum swing adsorption unit used to reduce the pressure during step 3 (Blowdown and Purge). In this aspect, the adsorption beds are depressurized by venting countercurrently to nearly atmospheric pressure, and then further depressurized countercurrently with a vacuum pump to a subatmospheric pressure. A small amount of the product gas from stream 42 or the purge gas stream is then used to countercurrently purge the beds at the same subatmospheric pressure. This approach uses less purge gas than a typical pressure swing adsorption unit.

In a further aspect of the invention, the adsorption unit 200 may be replaced with a membrane separation unit (not shown). In such aspects, the membrane separator is chosen such that it has a selectivity preferring ethane and propane over methane. The product gas 42 (enriched in methane and depleted in NGL) exits the membrane separator and can be directed to the pipeline, while the effluent stream 43 (containing a higher concentration of heavy hydrocarbon components) is treated as described above in compressor 210 and heat exchanger 220 as necessary to meet downstream temperature and pressure requirements.

Referring now to FIG. 3, FIG. 3 shows another aspect of the invention wherein stream 43 is compressed to the same pressure as stream 1 and mixed with stream 2 prior to entering the heat exchanger 100. Heat exchanger 220 is used to remove the heat of compression so that the temperature of stream 45 is similar to the feed gas stream 1. This change has the overall effect of making the feed stream 2 slightly heavier.

The following Examples are provided to illustrate certain aspects of the invention and do not limit the scope of the claims appended hereto.

EXAMPLES

Process simulations were conducted to determine the utility of PSA processes for the rejection of ethane and heavier components from raw natural gas. A computer simulation program was used to solve the dynamic mass, momentum, and energy balances during the various PSA steps and ultimately converge to a cyclic steady state condition. This simulation is described in the literature (Kumar, R. et al., "A Versatile Process Simulator for Adsorptive Separations," Chem. Eng. Sci. 3115, 1994) and has been demonstrated to effectively describe PSA performance. An adsorption isotherm and mass transfer data base was used to develop a multicomponent equilibrium model and estimates of mass transfer parameters needed in the simulations. PSA performance was evaluated by determining the methane recovery (methane in the high pressure product gas divided by methane in the feed gas), ethane rejection (ethane in the low pressure waste gas divided by the ethane in the feed gas), and production capability of the PSA process (million standard cubic feet per day, MMSCFD, of feed gas handled per PSA train). All compositions are given in mole percentages.

In Examples 1-4, the feed gas contains 78.8% methane, 0.5% carbon dioxide, 11.4% ethane, 5.2% propane, 3.1% butane, and 1.0% pentane at 120° F. and 68 atm (1000 psia). The feed gas flow rate is adjusted to yield 2% ethane in the high pressure product. Simulations are conducted at various purge gas flow rates to determine the optimum conditions for maximum methane recovery.

It can be desirable to make the PSA unit mobile, so that it may be easily relocated from one plant to another as needed. The PSA beds simulated in this example were relatively short by typical standards for hydrogen separation. For example, the packed length is about 8 feet rather than the more typical 20-30 feet of a hydrogen PSA system. The reduced length of these beds makes it possible to load them in a vertical orientation on a flatbed trailer or skid assembly that can be transported via conventional means. This is counterintuitive, as equilibrium-controlled PSA separation processes are typically operated with longer beds, with length to diameter ratios (L/D) generally greater than 1.5, and preferably higher. In contrast, the L/D value for the current PSA process is less than 1.5.

Activated alumina (Alcan AA300) is packed in the PSA vessels, which are about 6 feet in diameter. The pressure equalization (PE) steps are controlled so at the end of each step there is a pressure difference between the bed providing PE and the one receiving it of about 0.1 atm. The PE step time is adjusted so the gas velocity in the bed providing PE is less than 50% of the velocity capable of fluidizing the adsorbent. The blowdown and purge steps are conducted at a pressure of 1.4 atm (20.6 psia).

Example 1: 12-Bed PSA Process

A PSA process utilizing 12 adsorber beds was simulated. The process cycle steps are outlined in Table 1, where "PE" designates a pressure equalization step. The cycle includes six pressure equalization steps, and two beds received feed gas at all times. Process performance is listed in Table 2. A single train of beds can process 30 MMSCFD feed gas and produce a product comprising methane with 2% ethane, 140 ppm $CO_2$, and less than 700 ppm of $C_3$ and higher hydrocarbon components. Methane recovery to the high pressure product is 78.9%, and ethane and propane rejection levels are 88.9% and 99.4%, respectively.

This example illustrates that a PSA with relatively short beds can effectively separate the heavy components from the raw natural gas feed stream.

TABLE 1

| PSA Cycle Steps | | |
|---|---|---|
| Example 1 | Example 2 | Example 3 |
| Feed | feed | feed |
| provide PE1 | provide PE1 | provide PE1 |
| provide PE2 | provide PE2 | provide PE2 |
| provide PE3 | provide PE3 | |
| provide PE4 | provide PE4 | |
| provide PE5 | | |
| provide PE6 | | |
| provide purge | provide purge | provide purge |
| Blowdown | blowdown | blowdown |
| receive purge | receive purge | receive purge |
| receive PE6 | | |
| receive PE5 | | |
| receive PE4 | receive PE4 | |
| receive PE3 | receive PE3 | |
| receive PE2 | receive PE2 | receive PE2 |
| receive PE1/repress with product | receive PE1/repress with produce | receive PE1 |
| repress with product | repress with product | repress with product |

Example 2: 10-Bed PSA Process

A PSA process utilizing 10 adsorber beds was simulated. The process cycle steps are outlined in Table 1. The cycle included four pressure equalization steps, and two beds received feed gas at all times. Process performance is listed in Table 2. A single train of beds can process 30.6 MMSCFD feed gas and produce a product comprising methane with 2% ethane, 130 ppm $CO_2$, and less than 600 ppm of $C_3$ and higher hydrocarbon components. Methane recovery to the high pressure product is 75.1%, and ethane and propane rejection levels are 89.4% and 99.6%, respectively.

This example illustrates that using fewer beds (10 rather than 12) can yield lower overall capital costs and similar $C_2$ and $C_3$ rejection, but also results in about 4% lower methane recovery.

TABLE 2

Simulation Results

| Example No. | Feed per train (6 ft. ID beds), MMSCFD | Methane Yield, % | $CO_2$ Yield, ppm | Ethane Yield, % | Methane Recovery, % | Ethane Rejection, % | Propane Rejection, % |
|---|---|---|---|---|---|---|---|
| 1 | 30.0 | 97.9 | 138.1 | 2.0 | 78.9 | 88.9 | 99.4 |
| 2 | 30.6 | 97.9 | 126.7 | 2.0 | 75.1 | 89.4 | 99.6 |
| 3 | 30.3 | 97.9 | 250.4 | 2.0 | 64.6 | 90.9 | 99.0 |

Example 3: 5-Bed PSA Process

A PSA process utilizing 5 adsorber beds was simulated. The process cycle steps are outlined in Table 1. The cycle included two pressure equalization steps, and only one bed received feed gas at any time during the cycle. Process performance is listed in Table 2. A single train of beds can process 30.3 MMSCFD feed gas and produce a product comprising methane with 2% ethane, 250 ppm $CO_2$, and less than 1600 ppm of $C_3$ and higher hydrocarbon components. Methane recovery to the high pressure product is 64.6%, and ethane and propane rejection levels are 90.9% and 99.0%, respectively.

This example illustrates that using as little as five beds can yield high $C_2$ and $C_3$ rejection, but at about 18% lower methane recovery than the 12-bed process.

Example 4: 6-Bed PSA Process with Partial Waste Gas Rinse

Simulations were conducted with a cycle similar to the 5-bed cycle described in Example 3, except that an additional high pressure rinse step is included between the feed and first pressure equalization steps. A portion of the low pressure waste gas collected from the blowdown and purge steps is compressed to feed pressure and used as the rinse gas. An additional bed is added to accommodate this step, so a 6-bed process is simulated. The cycle includes two pressure equalization steps and only one bed on feed gas at any time during the cycle. Bed length is 8 feet in these simulations.

Process performance is listed in Table 3. Increasing the amount of rinse gas used in the cycle substantially increases the methane recovery to the high pressure product, while invoking only a small decrease in $C_2$ rejection.

TABLE 3

Simulation Results for PSA Rinse Cycle

| Example No. 4 | Rinse/Feed (mole/mole) | Methane Recovery, % | Ethane Rejection, % | Propane Rejection, % |
|---|---|---|---|---|
| (no rinse) | 0.00 | 64.6 | 90.9 | 99.0 |
| | 0.09 | 70.2 | 90.1 | 99.1 |
| | 0.19 | 76.4 | 89.2 | 99.1 |
| (high rinse) | 0.31 | 82.9 | 88.3 | 99.1 |

This example demonstrates the potential value of a rinse step using a portion of the PSA waste gas.

Example 5

The effectiveness of the instant invention was modeled using commercially available process modeling software from Aspen Technologies. The results for a 39 MMSCFD PSA are used to improve a 200 MMSCFD GSP plant. In both embodiments of the invention, the PSA allows the plant to process about 228 MMSCFD while using the same compression power demand in the booster compressor and maintaining roughly the same vapor flow rate in the demethanizer column. Flow rates for plants including a PSA similar in configuration to those depicted in FIGS. 2 and 3, as well as comparative flow rates for configurations without a PSA, are given in Table 4. All flow rates are in lbmol/hr.

TABLE 4

Simulated Flow Rates of Selected Process Streams

| | Plant with no PSA | | |
|---|---|---|---|
| | Stream 1 | Stream 14 | Stream 15 |
| methane | 17050 | 16990 | 60 |
| ethane | 2450 | 80 | 2370 |
| propane | 1120 | 2 | 1118 |

| | Stream 1 | Stream 14 | Stream 15 | Stream 41 | Stream 42 | Stream 43 |
|---|---|---|---|---|---|---|
| | Plant with PSA - consistent with FIG. 2 | | | | | |
| methane | 19430 | 16660 | 70 | 3330 | 2700 | 630 |
| ethane | 2790 | 100 | 2640 | 480 | 55 | 425 |
| propane | 1275 | 2 | 1273 | 220 | 0 | 220 |
| | Plant with PSA - consistent with FIG. 3 | | | | | |
| methane | 19430 | 16670 | 65 | 3330 | 2700 | 630 |
| ethane | 2790 | 120 | 2610 | 480 | 55 | 425 |
| propane | 1275 | 3 | 1272 | 220 | 0 | 220 |

Example 6

The effectiveness of the instant invention was modeled using commercially available process modeling software from Aspen Technologies. The results for a 50 MMSCFD membrane with a selectivity of ethane over methane of 2.5 and propane over ethane of 6.0 are used to improve a 200 MMSCFD GSP plant. In both embodiments of the invention, the membrane allows the plant to process about 230 MMSCFD while using the same compression power demand in the booster compressor and maintaining roughly the same vapor flow rate in the demethanizer column. Flow rates for plants including a membrane separator similar in configuration to those depicted in FIGS. 2 and 3, as well as comparative flow rates for configurations without a membrane separator, are given in Table 5. All flow rates are in μmol/hr.

TABLE 5

Simulated Flow Rates of Selected Process Streams

| | Plant with no PSA | | |
|---|---|---|---|
| | Stream 1 | Stream 14 | Stream 15 |
| methane | 17050 | 16990 | 60 |
| ethane | 2450 | 80 | 2370 |
| propane | 1120 | 2 | 1118 |

| | Stream 1 | Stream 14 | Stream 15 | Stream 41 | Stream 42 | Stream 43 |
|---|---|---|---|---|---|---|
| | Plant with PSA - consistent with FIG. 2 | | | | | |
| methane | 19980 | 17740 | 60 | 4630 | 2180 | 2180 |
| ethane | 2870 | 275 | 2480 | 625 | 115 | 510 |
| propane | 1310 | 10 | 1300 | 285 | 5 | 280 |
| | Plant with PSA - consistent with FIG. 3 | | | | | |
| methane | 19980 | 17740 | 60 | 4360 | 2180 | 2180 |
| ethane | 2870 | 275 | 2480 | 625 | 115 | 510 |
| propane | 1310 | 10 | 1300 | 285 | 5 | 280 |

While the invention has been described with reference to certain aspects or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A system for treating raw natural gas comprising:

(i) a raw natural gas stream formed by diverting a fraction of a main raw natural gas feed stream;

(ii) an adsorption unit configured to receive the raw natural gas stream and produce a first stream comprising methane and enriched in natural gas liquids and a second stream comprising methane and depleted in natural gas liquids;

(iii) a compressor or pump configured to receive and increase the pressure of the first stream to produce a gas processing plant feed stream; and (iv) a gas processing plant configured to receive the gas processing plant feed stream, wherein the gas processing plant comprises:

(a) a secondary main raw natural gas feed stream formed by the portion of the main raw natural gas feed stream remaining after diversion of the raw natural gas feed stream;

(b) a first heat exchanger configured to receive and cool the secondary main raw natural gas feed stream to produce a cooled feed stream;

(c) a separation unit configured to receive the cooled feed stream and separate it into a vapor feed stream and a liquid feed stream;

(d) an expander configured to receive and expand a portion of the vapor feed stream to form a main demethanizer feed stream;

(e) a second heat exchanger configured to receive and condense a portion of the vapor feed stream, a portion of the cooled feed stream, a portion of a demethanizer overhead stream, or any combination thereof to form a demethanizer reflux stream; and (f) a demethanizer configured to receive the main demethanizer feed stream, the liquid feed stream, and the methanizer reflux stream and produce the demethanizer overhead stream comprising methane and a demethanizer bottoms stream comprising natural gas liquids; and wherein the system further comprises a third heat exchanger configured to receive and cool the gas processing plant feed stream before the gas processing plant feed stream is combined with the liquid feed stream to form a combined demethanizer feed stream and the combined demethanizer feed stream is fed directly to the demethanizer.

2. The system of claim 1, wherein the raw natural gas stream comprises at least 60% methane by volume.

3. The system of claim 1, wherein the raw natural gas stream comprises less than 2% carbon dioxide by volume.

4. The system of claim 1, wherein the raw natural gas stream comprises less than 100 ppm water vapor by volume.

5. The system of claim 1, wherein the pressure of the raw natural gas stream is greater than 700 psia.

6. The system of claim 1, wherein the adsorption unit is a pressure swing adsorption unit.

7. The system of claim 6, wherein the lowest pressure in the pressure swing adsorption unit during any single cycle is 1 atm.

8. The system of claim 1, wherein the beds of the adsorption unit have a length to diameter ratio less than 1.5.

* * * * *